United States Patent [19]

Takahashi et al.

[11] Patent Number: 4,607,184

[45] Date of Patent: Aug. 19, 1986

[54] BRUSH HOLDER WITH AUTOMATICALLY RELEASED RETAINER

[75] Inventors: Kazuyuki Takahashi; Yasuhiro Oe; Etushi Yamamoto, all of Hiroshima, Japan

[73] Assignee: Ryobi Ltd., Hiroshima, Japan

[21] Appl. No.: 678,427

[22] Filed: Dec. 5, 1984

[30] Foreign Application Priority Data

Dec. 21, 1983 [JP] Japan ..... 58-242784

[51] Int. Cl.[4] ..... H01R 39/38

[52] U.S. Cl. ..... 310/247; 310/242

[58] Field of Search ..... 29/597; 310/42, 239, 310/242, 245, 247, 240, 241, 243, 244, 246

[56] References Cited

U.S. PATENT DOCUMENTS 3,387,155 6/1968 Krulls ..... 310/247

4,354,128 10/1982 Chew et al. ..... 310/247

*Primary Examiner*—Patrick R. Salce

*Assistant Examiner*—D. L. Rebsch

*Attorney, Agent, or Firm*—Sughrue, Mion, Zinn Macpeak & Seas

[57] ABSTRACT

A brush holder adapted for automatic assembly having a simplified construction and reduced cost. The brush holder is composed of a generally U-shaped holder box having an opening extending from a top end thereof along one side of the box, and a holder plate covering the opening. The holder plate has a recess for receiving the brush therein, and a stop for preventing movement of the brush through the opening of the holder box when retained by the stop. When the brush is to be mounted on a motor casing or the like, a protrusion of the motor casing is extended through a through-hole in the holder plate, thereby releasing the brush from engagement with the brush stop and permitting it to protrude through the hole in the top end of the box.

5 Claims, 4 Drawing Figures

BRUSH HOLDER WITH AUTOMATICALLY RELEASED RETAINER

BACKGROUND OF THE INVENTION

The present invention relates to a brush holder used for a small motor.

A conventional brush holder is typically composed of a brush casing, a top plate electrically connected to a brush through a pigtail lead, and a pressing plate. The brush casing is constructed by soldering together a plate and a U-shaped body. The brush is electrically connected to the top plate through a pigtail lead, and a brush spring is disposed between the brush and the top plate. After inserting the brush into the brush casing, the pressing plate is inserted into two slits formed in opposite side walls of the body of the brush casing, and opposite ends of the pressing plate are then bent vertically to thereby fix the top plate to the brush casing. Since the pressing plate is mounted on the top plate, it is required to reduce a connecting solder portion, formed on the top plate and used for making electrical connection to the pigtail lead, so as to be flat.

The thus-constructed brush holder, however, has a large number of component elements and requires a large number assembly steps, many of which must be performed manually. Accordingly, the product is expensive. As a further drawback, it is very troublesome to insert the brush into, and remove it from the casing.

SUMMARY OF THE INVENTION

The present invention is intended to provide a brush holder in which the above-described drawbacks of the conventional brush holder have been eliminated.

A brush holder according to the present invention is composed of a holder box and a holder plate, and is constructed and assembled in such a manner that the holder box and the holder plate are united through a top plate positioned therebetween. Since the assembly operation of the brush holder is simplified, it becomes possible to assemble the brush holder automatically using an automatic assembly machine, to thereby reduce the cost of the product by improving the efficiency of its assembly. In the assembled brush holder according to the present invention, the brush can be easily inserted into the brush holder.

DESCRIPTION OF THE PREFERRED EMBODIMENTS

Figure 1:
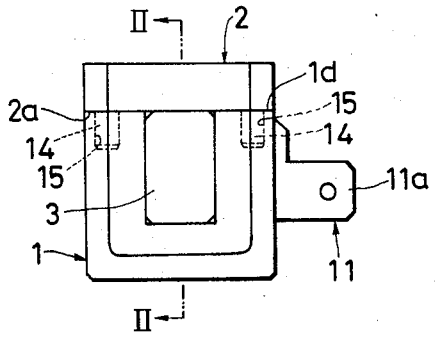
FIG. 1 is a plan view of a brush holder according to the present invention.

A preferred embodiment of the present invention will be explained referring to the drawings.

As shown in FIGS. 1 to 4, a brush holder according to the present invention is constituted by an assembly of two members, a holder box 1 and a holder plate 2. The holder box 1 is formed in a substantially U shape (in a plan view thereof) having an opening at one side which extends from a top end along one side of the box. At an inner portion of the holder box 1, a concave portion 1*a* is formed which receives a brush 3. A groove 1*c* is formed at a lower side wall of the holder box 1, extending to an inner surface of a bottom wall 1*b*, receiving therein a top plate 11.

Figure 2:
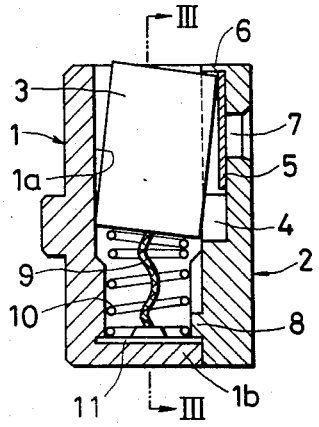
FIG. 2 is a cross-sectional side view of the brush holder of FIG. 1 cut away along a line II—II in FIG. 1.
Figure 3:
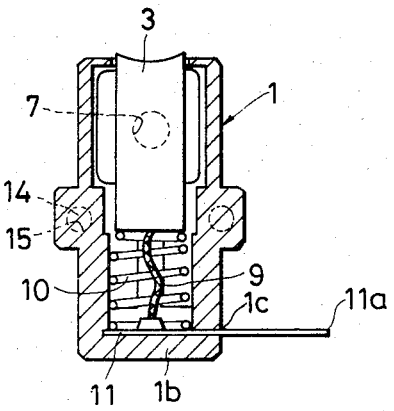
FIG. 3 is a cross-sectional side view of the brush holder of FIG. 2 cut away along a line III—III in FIG. 2.

The holder plate 2 is formed in a plate-like configuration having a size sufficient for covering the opening of the holder box 1. At an upper portion of an inner surface of the holder plate 2 there is formed a concave portion 4 having a size corresponding to the brush 3 to slidably receive the side of the brush 3, in a horizontal direction as shown in FIG. 2. A brush stop 6, formed at a top inner wall of the holder plate 2 is provided to retain the brush 3 at its top surface. A mounting through-hole 7 is formed in the upper side wall of the holder plate 2 with the inner end thereof communicating with the concave portion 4. Further, a projecting portion 8 is formed integrally with a bottom portion of the inner wall of the holder plate 2.

The brush holder is assembled by first disposing the open side of the holder box 1 and the inner wall of the holder plate 2 opposite one another and thereafter uniting the holder box 1 and the holder plate 2. However, before assembling these members, the plate 11, which is electrically connected to the brush 3 through a pigtail lead 9, is placed on an inner surface of the bottom wall 1*a* of the holder box 1 and inserted into the groove 1*c*, and then the brush 3 is disposed in the brush box 1. Further, the brush plate 5 is placed in the concave portion 4 of the holder plate 2. In this state, the holder box 1 and the holder plate 2 are assembled, and an end portion of the top plate 11 is inserted into the space between the inner surface of the bottom wall 1*a* of the holder box 1 and the bottom surface of the projecting portion 8, thereby uniting the brush box 1, holder plate 2 and the top plate 11 as shown in FIG. 2. Thereafter, the brush 3 is pressed into the brush holder 1 against the extending force of the spring 10 and then inclined toward the holder plate 2 in such a manner that the top end portion of the brush 3 is engaged with the brush stop 6 so as to retain the brush 3 in the brush holder 1.

Figure 4:
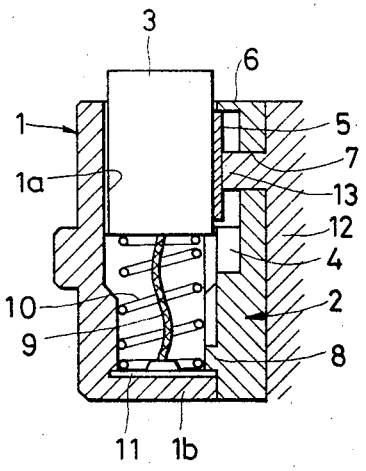
FIG. 4 is a cross-sectional side view showing the state in which the brush is disengaged from a brush stop.

To mount the thus-constructed brush holder to a motor casing 12, as shown in FIG. 4, a projection 13 of the casing 12 is fitted into the mounting through-hole 7. If the projection 13 has a length sufficiently greater than the depth of the mounting through-hole 7, when the projecting portion 13 is inserted into the through-hole 7, the brush plate 5 is pressed toward the inner portion of the holder box 1 by the projecting portion 13 so that the brush 3 is disengaged from the brush stop 6 and then pushed upwardly by the extending force of the spring 10 so that the upper portion of the brush 3 protrudes from the holder box 1. Thus, the brush holder is set in position for use.

The holder box 1 and the holder plate 2 can be fixed together by applying an adhesive to opposing surfaces 1*d* and 2*a* of the holder box 1 and the holder plate 2, or by providing projections 14 and concave portions 15 on the opposing surfaces 1*d* and 2*a* with the projections 14 fitted into the concave portions 15 with or without applying adhesive to the concave portions.

In the thus-constructed brush holder according to the present invention, the holder box 1 and the holder plate 2 can be assembled by inserting the top plate 11 at the lower portion of the holder box and the holder plate, thereby simultaneously assembling the brush 3, which is electrically connected to the top plate 11 through the pigtail lead 9. Further, the holder box 1 and the holder plate 2 can be assembled by a simple operation such as by aligning the opposing surfaces thereof. Therefore, the required assembly operations can readily be performed by an automatic assembly machine, thereby improving the production efficiency and assuring the accuracy of the assembly operations and thus reducing the costs of production.

In the assembled brush holder according to the present invention, the brush 3 is initially held in the holder box in such a manner that the brush 3 is engaged with the brush stop 6. Hence the brush 3, particularly, the top portion thereof, is protected in the holder box prior to final assembly to the motor casing 12. Further, because the brush 3 is disengaged from the brush stop 6 and caused to protrude from the holder box simply by inserting the projecting portion 13 of the motor casing 12 into the mounting through-hole 7 of the holder plate 2, the brush holder can be easily mounted to a motor.

We claim:

1. A brush holder comprising:

a generally U-shaped holder box having an opening extending from a top end thereof along one side thereof; and a holder plate covering said opening of said holder box, said holder box having a brush stop at an inner surface of a top end thereof for holding a brush in said holder box, said holder plate having a through-hole therein for receiving a protruding member for releasing said brush from said brush stop to permit said brush to protrude from said holder.

2. The brush holder of claim 1, wherein said holder plate has a concave portion at an inner surface thereof for receiving said brush when held by said brush stop.

3. The brush holder of claim 2, further comprising a plate "a extending through a groove" in a bottom wall of said holder box.

4. The brush holder of claim 3, wherein said holder plate is joined to said holder box by an adhesive.

5. The brush holder of claim 3, wherein said holder plate is joined to said holder box by mating of at least one pair of a projection and a recess on opposing surfaces of respective ones of said holder plate and holder box.

* * * * *